US006719605B2

(12) United States Patent
Ichikawa

(10) Patent No.: US 6,719,605 B2
(45) Date of Patent: Apr. 13, 2004

(54) DRIVING DEVICE AND ACTION TOY

(75) Inventor: Takashi Ichikawa, Tochigi (JP)

(73) Assignee: Tomy Company, Ltd., Tokyo (JP)

( * ) Notice: Subject to any disclaimer, the term of this patent is extended or adjusted under 35 U.S.C. 154(b) by 11 days.

(21) Appl. No.: 10/282,072

(22) Filed: Oct. 29, 2002

(65) Prior Publication Data

US 2003/0124951 A1 Jul. 3, 2003

(30) Foreign Application Priority Data

Dec. 28, 2001 (JP) ..... 2001-400407
Mar. 20, 2002 (JP) ..... 2002-078673

(51) Int. Cl.[7] ..... A63H 11/00
(52) U.S. Cl. ..... 446/330; 446/129
(58) Field of Search ..... 446/330, 268, 446/272, 280, 292, 484, 129, 133, 131, 352–353, 354, 355, 457, 462

(56) References Cited

U.S. PATENT DOCUMENTS

| | | | | |
|---|---|---|---|---|
| 3,783,550 A | | 1/1974 | Andrews | |
| 4,471,566 A | * | 9/1984 | Ishimoto | 446/129 |
| 4,717,364 A | | 1/1988 | Furukawa | |
| 5,446,236 A | | 8/1995 | Nakada et al. | |
| 5,791,946 A | | 8/1998 | Mendez | |
| 5,947,793 A | * | 9/1999 | Yamakawa | 446/431 |

FOREIGN PATENT DOCUMENTS

| | | |
|---|---|---|
| GB | 498651 | 1/1939 |
| GB | 2042913 | 10/1980 |
| GB | 2189915 | 11/1987 |
| JP | 02-283391 | 11/1990 |
| JP | 7012953 | 3/1995 |
| JP | 3069390 | 7/2000 |
| JP | 3075546 | 8/2000 |

* cited by examiner

*Primary Examiner*—Jacob K. Ackun
*Assistant Examiner*—J O Williams
(74) *Attorney, Agent, or Firm*—Staas & Halsey LLP

(57) ABSTRACT

A driving apparatus for an action toy comprising: a base member; a swing member (16) which is reciprocally swingable on a predetermined axis formed in the base member (10); an electromagnet (20) which is attached to one of the base member and the swing member; a control circuit (25) for controlling electric current supplied to the electromagnet; at least a magnetic material member (21, 22) which is attached to the other of the base member and the swing member to allow the swing member to swing reciprocally with respect to the base member by a magnetic force which acts between the electromagnet and the magnetic material member; and a ratchet mechanism (31, 32) for converting a swinging movement of the swing member to a rotational movement of a wheel, the ratchet mechanism comprising a ratchet pawl member (32) and ratchet teeth (31) engageable with the ratchet pawl member.

19 Claims, 9 Drawing Sheets

DRIVING DEVICE AND ACTION TOY

BACKGROUND OF THE INVENTION

1. Field of the Invention

The present invention relates to a driving device and an action toy using such a driving device.

2. Description of Related Art

A driving device for an action toy, which rotates wheels by transmitting the power of a driving source, e.g., a motor, to the wheels through gears for reduction, or swings hands and feet or the like of the toy by transmitting the power of the motor to the hands and feet or the like through a link work, is known.

However, a driving device having a motor are expensive, that is, a toy having such a driving device is also expensive. Further, a small sized toy requires a small-sized electric power and a small-sized motor, although it requires much energy to perform large actions by the rotational power of the small-sized motor and in particular, a type of driving device transmitting the power of the motor through gears dissipates the energy of battery hard.

For these reasons, conventionally, there were little driving devices suitable for a small-sized toy.

SUMMARY OF THE INVENTION

The invention has been made in view of the above problems.

An object of the invention is to provide a driving device which is applicable for a small-sized toy.

Another object of the invention is to provide an action toy using such a driving device.

In accordance with an aspect of the invention, the driving apparatus for an action toy comprising: a base member; a swing member which is reciprocally swingable on a predetermined axis formed in the base member; an electromagnet which is attached to one of the base member and the swing member; a control circuit for controlling electric current supplied to the electromagnet; at least a magnetic material member which is attached to the other of the base member and the swing member to allow the swing member to swing reciprocally with respect to the base member by a magnetic force which acts between the electromagnet and the magnetic material member; and a ratchet mechanism for converting a swinging movement of the swing member to a rotational movement of a wheel, the ratchet mechanism comprising a ratchet pawl member and ratchet teeth engageable with the ratchet pawl member.

Preferably, the ratchet teeth are provided in the wheel.

The swing member can be swung reciprocally, for example, by attaching a permanent magnet (or a magnetic material) onto one of the base member and the swing member, attaching an electromagnet onto the other, and changing the polarities of the electromagnet alternately by controlling the current flowing thereto. Although at least one permanent magnet is required, it is preferable to provide a pair of magnets. Preferably, a pair of magnets are arranged to face to one surface of the electromagnet along the swinging direction of the swing member so that the same side thereof have different polarities to each other. The swing member may be reciprocally moved linearly and also may be reciprocally swung around an axis. As the magnetic material, one other than permanent magnet may be also used.

The driving apparatus for an action toy move the swing member reciprocally by a magnetic force. Accordingly, only a small power is required to make the wheel perform a large action because of obtaining a large swinging stroke of the swing member. Because the reciprocal action of the swing member is converted to the action for the wheel, the driving apparatus enables making a toy using the driving apparatus perform complicated movements easily.

In the driving apparatus, the reciprocal swinging action of the swing member generated by a magnetic force is converted to the action for the wheel. In the swinging action, stroke of the swing member can be adjusted easily by properly setting the length of the arm from the rotational axis to the free end of the swing member.

In the driving apparatus, the reciprocal action of the swing member generated by a magnetic force is converted to the rotational action. Use for rotational action is wide for a toy. For example, rotational action can be used for rotating a wheel, rotating a propeller and the like. After a reciprocal action is converted to a rotational action, it is possible to act another action member by reducing the rotational action.

In the driving apparatus, the reciprocal action of the swing member generated by a magnetic force is converted to the rotational action for a wheel. Although the action converting means for converting the reciprocal action to the rotational action is not limited, a link mechanism or a ratchet mechanism can be used. A wheel generates little loss of electric power because of relatively small frictional resistance on ground or a floor.

Such a driving apparatus can be preferably applied for a robot (including a toy animal). For example, making a robot walk by moving the legs one by one requires a large electric power because of its large weight. However, use of wheels enables movement of a robot with a large weight by using a small power.

In the driving apparatus, the reciprocal action of the swing member generated by a magnetic force is converted to the rotational action by a ratchet mechanism. In the ratchet mechanism, the reciprocal action is converted to an intermittent rotational movement.

In the driving apparatus, the reciprocal action of the swing member generated by a magnetic force is converted to the rotational action through ratchet teeth formed in the wheel. Accordingly, it is possible to reduce the number of necessary parts in comparison with in case of ratchet teeth which are provided apart from the wheel.

Preferably, the swing member supports the ratchet pawl member to allow it to move in a vertical direction and to descend by its own weight. A projecting pawl may be formed at a portion of the ratchet pawl member in a descending direction of the ratchet pawl member by its own weight.

The swing member may support the ratchet pawl member by a projecting cylindrical bearing which is disposed on a side surface of the swing member and centered at the axis of swinging for the swing member.

The projecting cylindrical bearing may comprise a projection with a small width, which is formed on a periphery thereof and extending in a vertical direction, and a through hole may be formed in the ratchet pawl member so that the projecting cylindrical bearing is fitted with a play and the ratchet pawl member is movable with respect to the projecting cylindrical bearing in a vertical direction.

The through hole formed in the ratchet pawl member may have a first approximately rectangular hole with a width slightly larger than an outer diameter of the cylindrical bearing and a second hole with a width slightly larger than the small width of the projection of the cylindrical bearing.

Preferably, the ratchet teeth are provided in the wheel. The swing member may swing a leg of the action toy.

Preferably, the ratchet teeth are internal teeth. In such a structure, because the ratchet pawl member can be arranged inside the internal teeth, the whole driving apparatus can be small-sized.

In the driving apparatus, the current flowing in the electromagnet may be controlled in response to an external stimulation. The external stimulation includes external sound, radio wave, infrared radiation, light, pressure, stimulation by a person, e.g., stroking, slapping, and the like.

In such a driving apparatus, the reciprocal action of the swing member generated by a magnetic force which is controlled in response to an external stimulation is converted to the action of the wheel. Accordingly, it is possible to realize an interesting toy which can perform action changing according to the type of external stimulation.

The driving apparatus may perform a reaction in response to a length of the sound. The reaction is not limited and it includes an action of the swing member and of another action member, generation of sound, light emission, and other actions.

Because such a driving apparatus performs a reaction by recognizing a combination of lengths of elements of a sound, everybody can make the driving apparatus perform a desired action easily. The external sound includes a voice which may include one or more voice elements.

Preferably, the driving apparatus further comprises: a storage unit for storing sound information including a plurality of combinations each having a sound element or plural sound elements and a pose between the sound elements, of a sound, and a predetermined range of time length; and a processing unit for recognizing an external voice when a measured time length of the external voice is in the predetermined range of time length stored in the storage unit, and controlling to make a driver to perform a reaction for an action toy. corresponding to a recognized result.

According to the driving apparatus, it is possible to make the toy recognize the meaning of not only a word with a sound element but also a word with plural sound elements and a pose therebetween, on the basis of the combination of lengths of every sound element and pose, of the input voice. For example, when a speaker's voice is "Pochi, Osuwari!" which comprises a first sound element "Po-chi" which is a dog name in Japanese, a pose, and a second sound element, "Osuwari!" which means "Sit down!" in Japanese, the processing unit knows the combination of the lengths of the first sound element, a pose, and the second sound element and can recognize the meaning of the voice by referring to the information of lengths combination-toy reaction relationship, stored in the storage unit. Preferably, a predetermined range of time length to be accepted by the apparatus may be set for each sound element and pose, to adapt the apparatus for variations of rapid and slow speaking speed to some extent. Accordingly, the meaning of input voice of one or plural sound elements can be recognized for not only a rapid speaker but a slow speaker. Because the processing unit does not recognize the input voice when the time length of either of elements and pose is not in the predetermined range, the apparatus makes hardly a mistake about recognition or action.

The processing unit may further comprise a voice synthesis for composing a sound like a voice.

The driving apparatus may comprise: the storage unit for storing various voices synthesized by the voice synthesis; a voice output unit for outputting a voice synthesized by the voice synthesis; and a processing unit for recognizing an external voice when a measured time length of the external voice is in the predetermined range of time length with respect to the voice synthesized, and controlling to make a driver to perform a reaction for an action toy, corresponding to a recognized result.

According to the driving apparatus, it is possible to realize a conversation with the action toy at an extremely low cost, by making the processing unit perform both voice synthesis and voice recognition. For example, when the action toy outputs a synthesized voice "Ohayo" which means "good morning" in Japanese and thereafter a speaker speaks a voice "Ohayo" with a time length which is in the predetermined range with respect to the voice synthesized, the toy can recognize the speaker's voice as "Ohayo".

The driving apparatus may further comprise: a storage unit for storing sound information including a plurality of combinations each having a sound element or plural sound elements and a pose between the sound elements, or a sound, and a predetermined range of time length; and a processing unit for recognizing an external voice when a measured time length of the external voice is in the predetermined range of time length stored in the storage unit, and controlling to make a driver to perform a reaction for an action toy, corresponding to a recognized result.

According to the driving apparatus, it is possible to enjoy a quiz in which the apparatus gives a synthesized voice, e.g., the highest mountain in Japan?, and thereafter requires an association to the synthesized voice to the speaker. When the speaker gives an external voice of correct answer "Fuji-san" to the apparatus, the toy recognizes the external voice as the speaker's voice.

The driving apparatus may comprise a button type of battery (cell) as a power source. Accordingly, the driving apparatus can be small-sized. As the power source, a structure for a small-sized storage battery, e.g., Ni—Cd (nickel-cadmium) battery, can be also used.

The driving apparatus may further comprise a button type of battery as a power source. Accordingly, it is possible to realize a In accordance with a second aspect of the invention, the action toy having a driving apparatus, wherein the driving apparatus comprises: a base member; a swing member which is reciprocally swingable on a predetermined axis formed in the base member; an electromagnet which is attached to one of the base member and the swing member; a control circuit for controlling electric current supplied to the electromagnet; at least a magnetic material member which is attached to the other of the base member and the swing member to allow the swing member to swing reciprocally with respect to the base member by a magnetic force which acts between the electromagnet and the magnetic material member; and a ratchet mechanism for converting a swinging movement of the swing member to a rotational movement of a wheel, the ratchet mechanism comprising a ratchet pawl member and ratchet teeth engageable with the ratchet pawl member.

According to the action toy having such a structure, it enables performing a large action and complicated movements easily by using only a small power.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

The toy animal using a driving device, according to an embodiment of the present invention will be explained with reference to the attached drawings, as follows.

Figure 1:
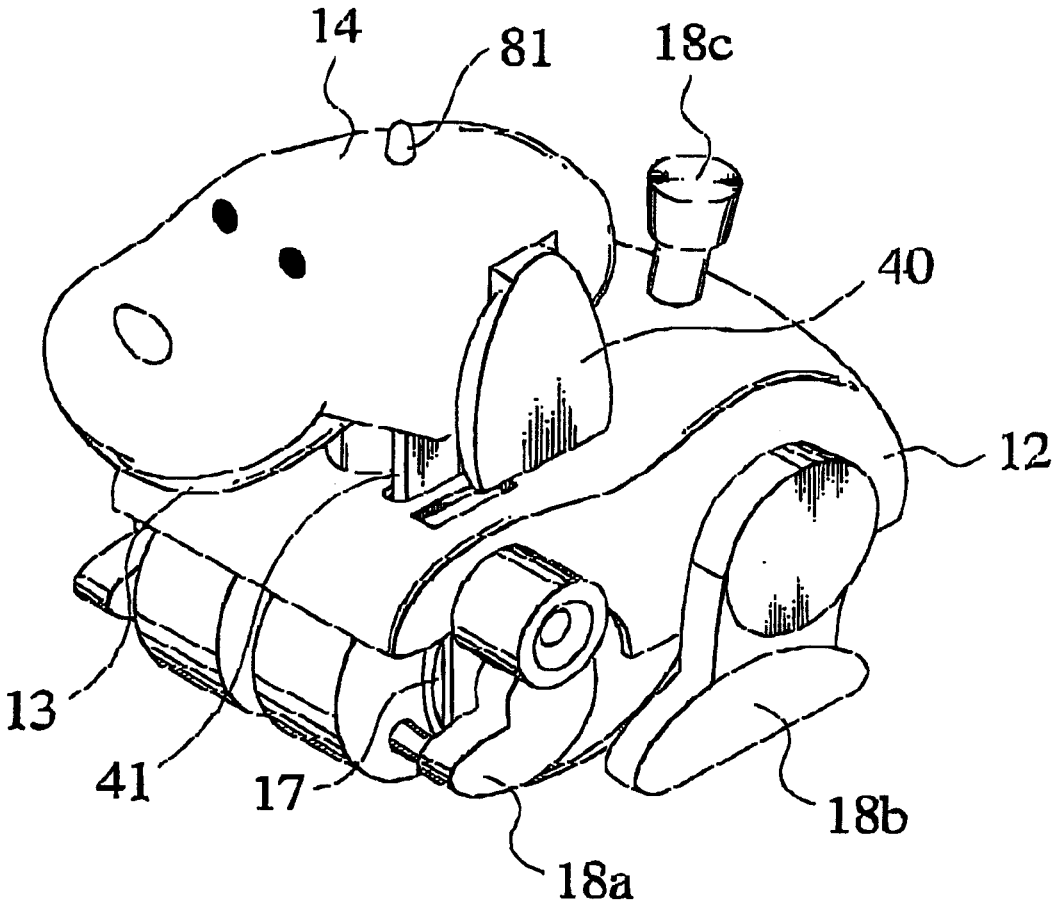
FIG. 1 is a perspective view of an action toy (toy animal) using a driving device, according to an embodiment of the present invention.
Figure 2:
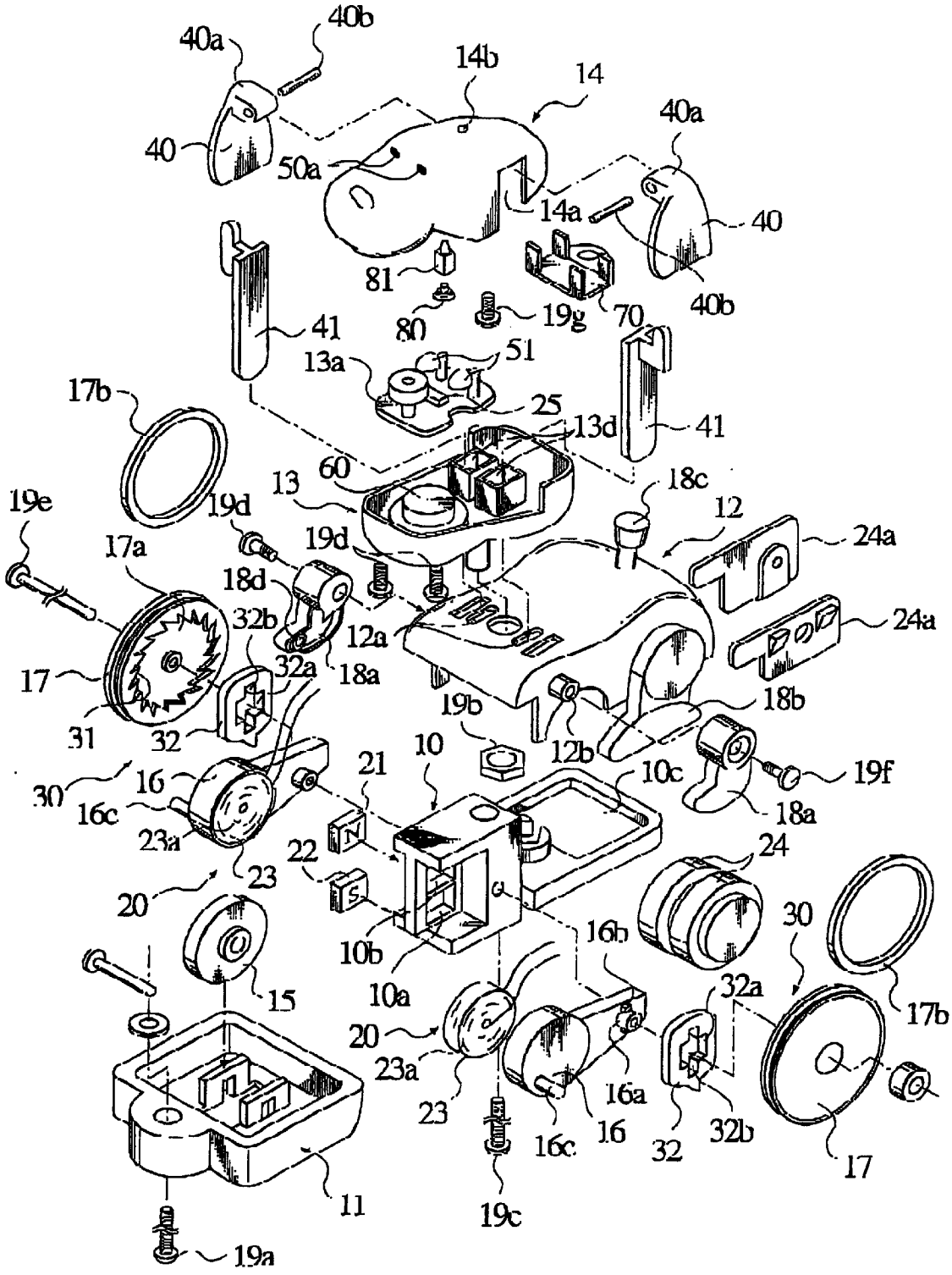
FIG. 2 is an exploded perspective view of the toy animal shown in FIG. 1.

FIG. 1 is a perspective view showing the appearance of the toy animal, and FIG. 2 is the exploded perspective view thereof.

As shown in FIG. 2, the toy animal is provided with a base member 10 and a case. The case comprises: a lower body cover 11 which forms the lower half of a body cover and is provided on the lower surface of the rear portion of the base member 10, an upper body cover 12 which forms the upper half of the body cover and is provided on the upper surface of the base member 10, a lower head cover 13 which forms the lower half of a head cover and is provided at a position above the body cover, and an upper head cover 14 which forms the upper half of the head cover. To the lower body cover 11, a supplemental wheel 15 is attached to be rotatable.

In the toy animal, a pair of swing members (action member) 16 and 16 are attached on both side surfaces of the front portion of the base member 10. Each swing member 16 has a projecting cylindrical bearing 16*a* which receives a shaft 19*e*, and can be swung centered on the shaft 19*e*. Between the base member 10 and each swing member 16, a driving mechanism 20 is disposed to swing the respective swing member 16.

The driving mechanism 20 comprises a pair of permanent magnets 21 and 22, a pair of electromagnets 23 and 23, a button-shaped cell 24 as an electric power supply, and an IC chip 25 which includes a control circuit for controlling the electric current supplied to the electromagnets 23 and 23, and the like.

Figure 3:
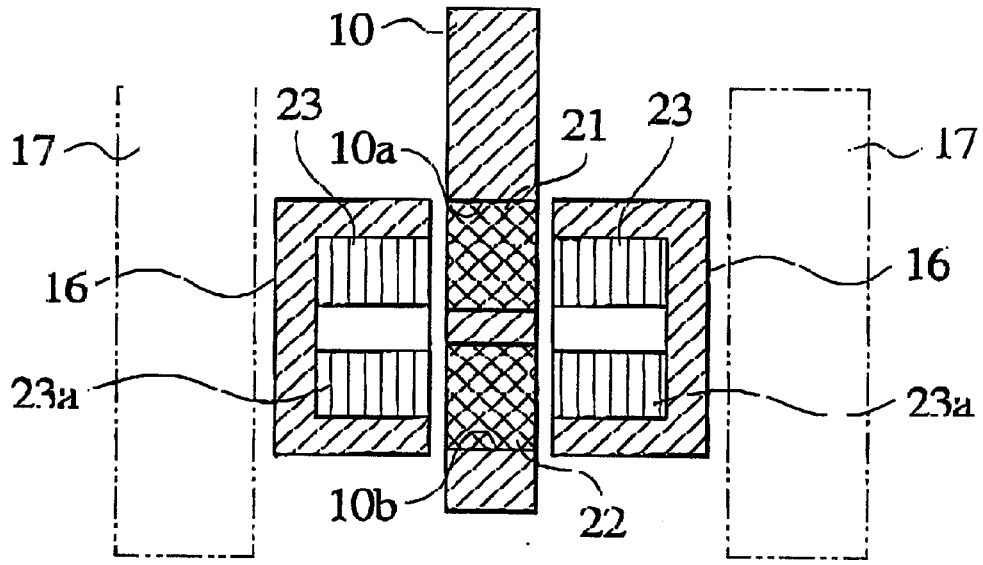
FIG. 3 is a vertical sectional view of a main portion, showing the positional relationship between permanent magnets and electromagnets in the toy animal shown in FIG. 2.

The permanent magnets 21 and 22 are mounted to fit into two through holes 10*a* and 10*b* which are formed in the front portion of the base member 10, respectively, as shown in FIG. 3. The magnets 21 and 22 are arranged at the upper and lower positions so that the surfaces in the same side of magnets 21 and 22 have different polarities to each other. That is, the magnets 21 and 22 are arranged so that when the surface in a side of magnet 21 has N-polarity, the surface in the same side of magnet 22 has S-polarity. The coil 23*a* of each electromagnet 23 is mounted to be contained in a circular recess portion which is formed in the inner surface of the free end of each swing member 16.

The lower head cover 13 is provided with a board 13*a*. In the rear portion of the base member 10, a through hole 10*c* is formed. The button-shaped cell 24 is disposed in the through hole 10*c* of the base member 10 to be in contact with terminal plates 24*a*. The coil 23*a* of each electromagnet 23 is electrically connected to the IC chip 25 which is installed on the board 13*a*, the button-shaped cell 24 and the like.

In the driving mechanism 20 having such a structure, the polarity of the electromagnet 23 is alternately changed by the signals supplied from a process unit 74 in the IC chip 25, so that the swing member 16 is swung. That is, the polarity of the electromagnet 23 in the side of the permanent magnets 21 and 22 is alternately changed from N polarity to S-polarity or from S-polarity to N-polarity, so that a repulsion force of an attraction force is given to N-polarity and S-polarity of the permanent magnets 21 and 22 which face to the electromagnet 23 repeatedly, to swing the swing member 16. In this case, the pair of swing members 16 and 16 may swing in synchronization with each other and may swing in phase different from each other.

The toy animal has a pair of wheels 17 and 17. The wheels 17 and 17 are attached to rotatable on the shaft 19*e*. Further, between each swing member 16 and each wheel 17, a ratchet mechanism 30 which includes a ratchet pawl member 32 is provided. In the circumferential periphery of each wheel 17, a groove is formed, as shown in FIG. 2. In the groove of the wheel 17, a rubber ring 17*b* is fitted.

Figure 4:
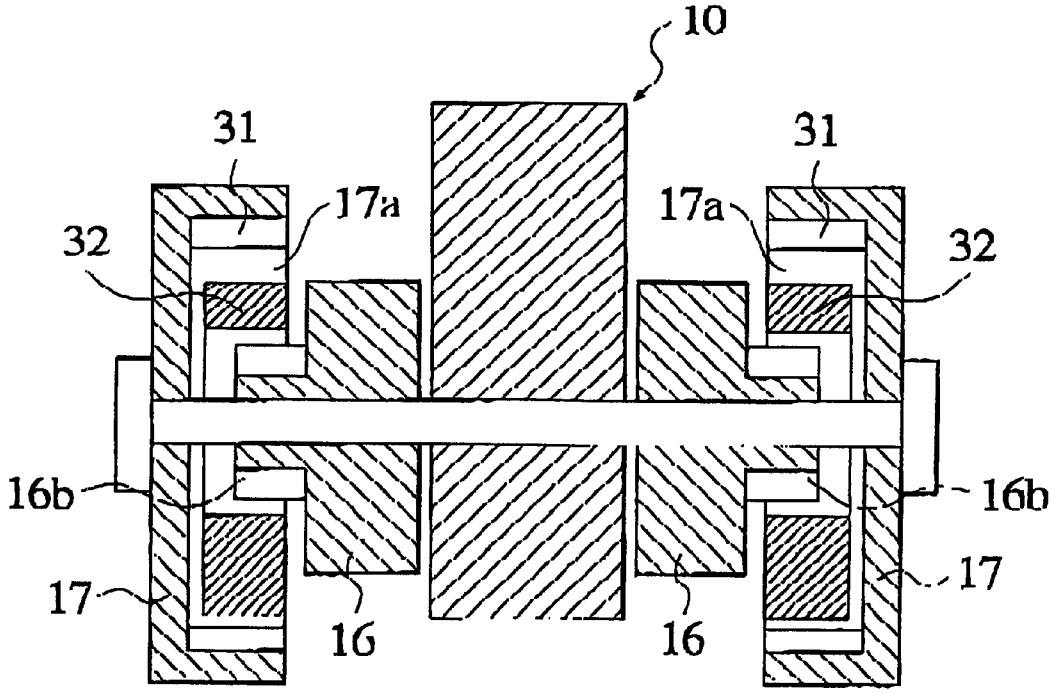
FIG. 4 is a vertical sectional view of a main portion, showing the arrangement relationship between swing members with ratchet claw members and wheels with ratchet teeth in the toy animal shown in FIG. 2.
Figure 5:
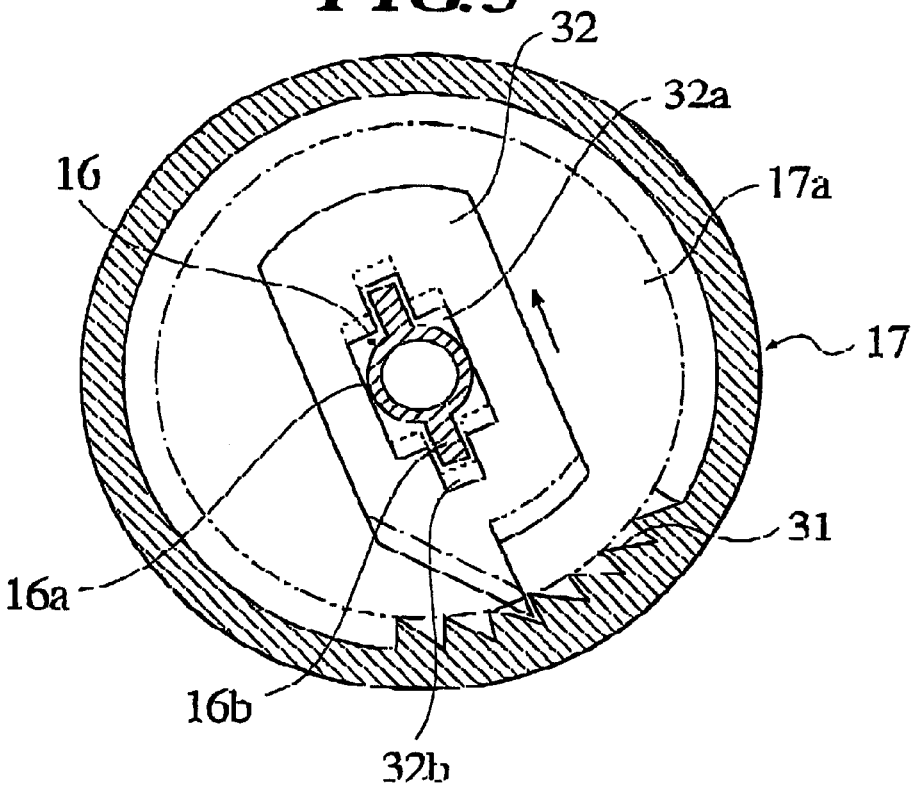
FIG. 5 is a view for showing the action of the ratchet mechanism shown in FIG. 4.

As shown in FIGS. 2 and 4, in the inner side portion of each wheel 17, a circular-shaped recess portion 17*a* is formed concentrically. In the inner circumferential wall of circular-shaped recess portion 17*a*, ratchet teeth 31 are formed, as shown in FIG. 5. On the periphery of projecting cylindrical bearing 16*a*, projections 16*b* are formed. In the ratchet pawl member 32, a pawl is formed at a lower outer side and, a through hole in which the projecting cylindrical bearing 16*a* of the swing member 16 can be fitted with play is formed at the center thereof. The through hole has an approximately rectangular hole 32*a* in which the projecting cylindrical bearing 16*a* is fitted with play, and thin rectangular holes 32*b* in which the projections 16*b* are fitted with play at upper and lower positions. The ratchet pawl member 32 can move in a diameter direction of the cylindrical bearing 16*a*, i.e., in the direction of projections 16*b* with respect to the bearing 16*a*, and can rotates together with rotation of the cylindrical bearing 16*a*. The ratchet pawl member 32 is contained in the recess portion 17*a* and engaged with ratchet teeth 31.

When the free end side of swing member 16 is swung downward, the cylindrical bearing 16*a* rotates together with the ratchet pawl member 32 in the counterclockwise direction, as shown in FIG. 5. As a result, the pawl of the ratchet pawl member 32 makes the wheel 17 rotate through the ratchet teeth 31 in the same direction. When the free end side of swing member 16 is swung upward, the cylindrical bearing 16*a* rotates together with the ratchet pawl member 32 in the clockwise direction, as shown in FIG. 5. However, the pawl of the ratchet pawl member 32 moves upward in the arrow direction in FIG. 5, as if the pawl escapes from the ratchet teeth 31 in the same direction, and slides to climb over the ratchet tooth 31. Then, the pawl falls down by the empty weight thereof to engage the next ratchet tooth 31. The wheel 17 is rotated in one direction by repeating such actions.

Figure 6:
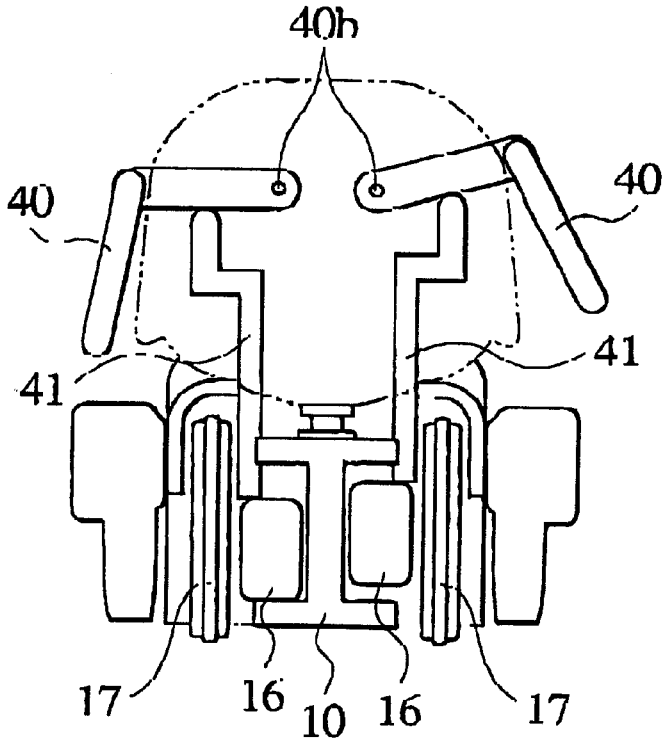
FIG. 6 is a vertical sectional view of the ear movement mechanism in the toy animal shown in FIG. 1.

The toy animal is provided with a pair of ear members 40 and 40 on the upper head cover 14. The base portions 40*a* and 40*a* of the ear members 40 and 40 are inserted in notches 14*a* which are formed at both sides of the upper head cover 14, and are attached to the upper head cover 14 by being supported on an attachment member 70 rotatably through shafts 40*b* and 40*b*. In the lower head cover 13 and the upper body cover 12, guide holes 13*d* and 13*d* and 12*a* and 12*a* are formed, respectively, for inserting a pair of bar-shaped members 41 and 41 through those holes. The lower end of one of bar-shaped members 41 is placed on the upper surface of one of swing members 16 and the upper end is in contact with the lower surface of base portion 40*a* of one of the ear members 40, as shown in FIG. 6. The lower end of the other of bar-shaped members 41 is placed on the upper surface of the other of swing members 16 and the upper end is in contact with the lower surface of base portion 40*a* of the other of the ear members 40. When the swing members 16 are swung, the corresponding bar-shaped member 41 is moved up or down, and thereby the corresponding ear member 40 is swung.

The toy animal is provided with a pair of eye members 50*a* and 50*a* on the upper head cover 14. On the board 13*a* which provided on the lower head cover 13, a pair of light emitters 51, e.g., LEDS or the like, are disposed. The light emitters 51 are arranged at the positions corresponding to that of eye members 50*a* and 50*a* when the upper head cover 14 and the lower head cover 13 are assembled.

In the toy animal, the light emitters 51 are turned on, for example, according to the signals for controlling the electromagnets 23, according to the signals for supplying to the speaker 60, or the like.

The toy animal is provided with a sound detection sensor which is not shown in figures and a speaker 60 on the lower head cover 13.

In the toy animal, when the sound detection sensor detects a sound, IC chip 25 selects one of reactions, e.g., running of the toy animal, swinging of the ear members, turning on of light emitters for eye members, generation of sound, and the like, which corresponds to the sound detected, and then the selected reaction is output through the speaker 60 or the like. For example, reactions, e.g., generation of various voices, performing actions or light-emitting, to be output are previously set and stored in a storage circuit in the IC chip, corresponding to combinations of the lengths of several sound elements of an input voice. Not only combinations of the lengths of sound elements but also the content, of an input voice which may be recognized by a voice recognition unit, may be used for determining the reaction.

Figure 7:
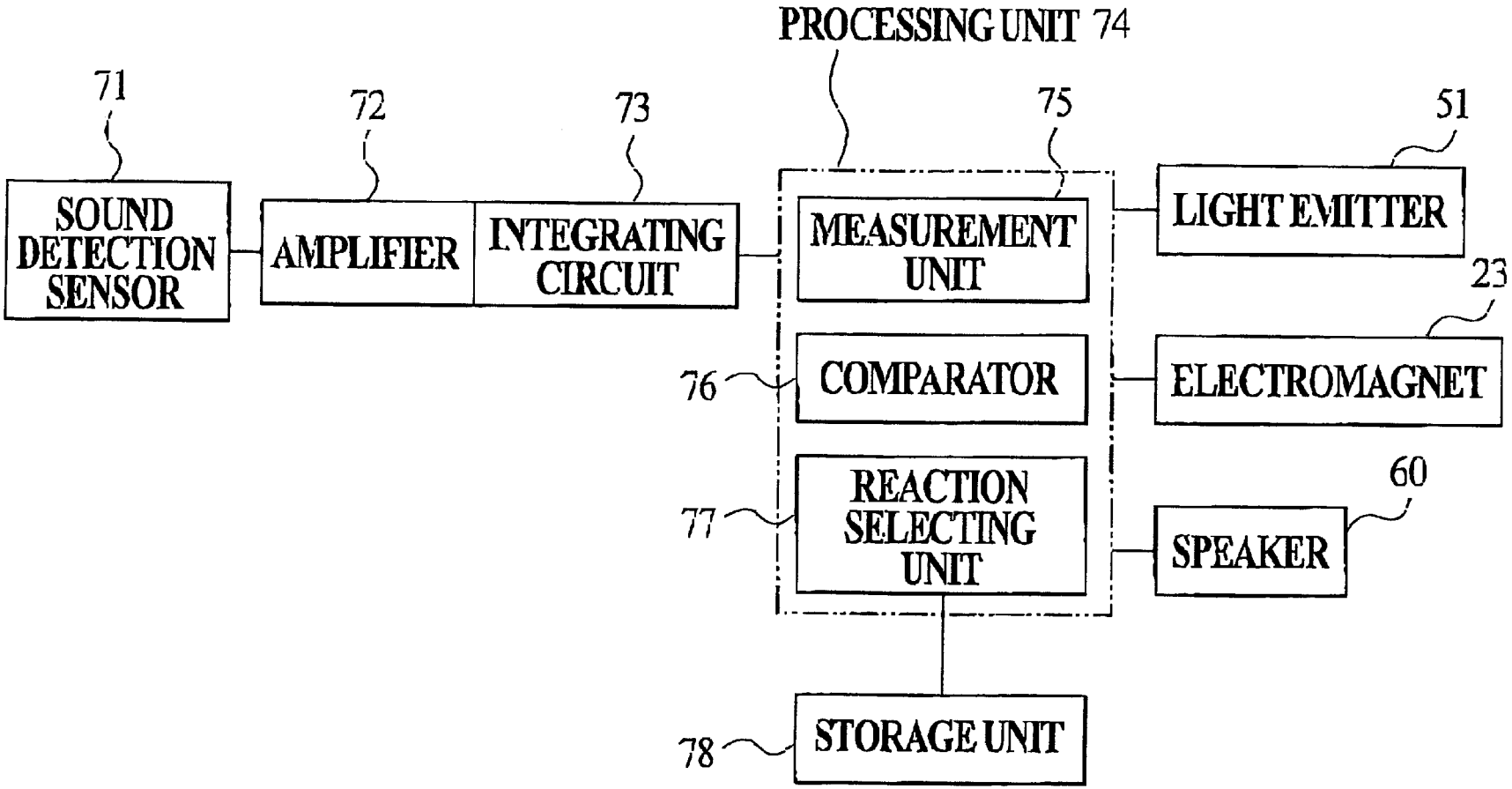
FIG. 7 is a block diagram of an embodiment of the sound recognition circuit for recognizing an external sound and the time length thereof, in the toy animal.

FIG. 7 shows a sound recognition circuit for recognizing sounds such as speaker's voices.

The sound recognition circuit comprises a sound detection sensor 71, e.g., microphone or the like, for detecting an external sound such as a speaker's voice to output a sound signal, an amplifier 72 for amplifying the sound signal given from the sound detection sensor 71, an integration circuit 73 for converting the sound signal amplified by the amplifier 72 to a digital sound signal, and a processing unit 74 which measures the combination of time lengths of sound elements of an external sound on the basis of the digital sound signal from the integration circuit 73 and recognizes the content of the external sound when the time length of sound elements is in a predetermined allowable range, and selects the reaction corresponding to the recognized result. The processing unit 74 exists in IC chip 25 and includes a control circuit for controlling the current to be supplied to the electromagnets 23.

Figure 8:
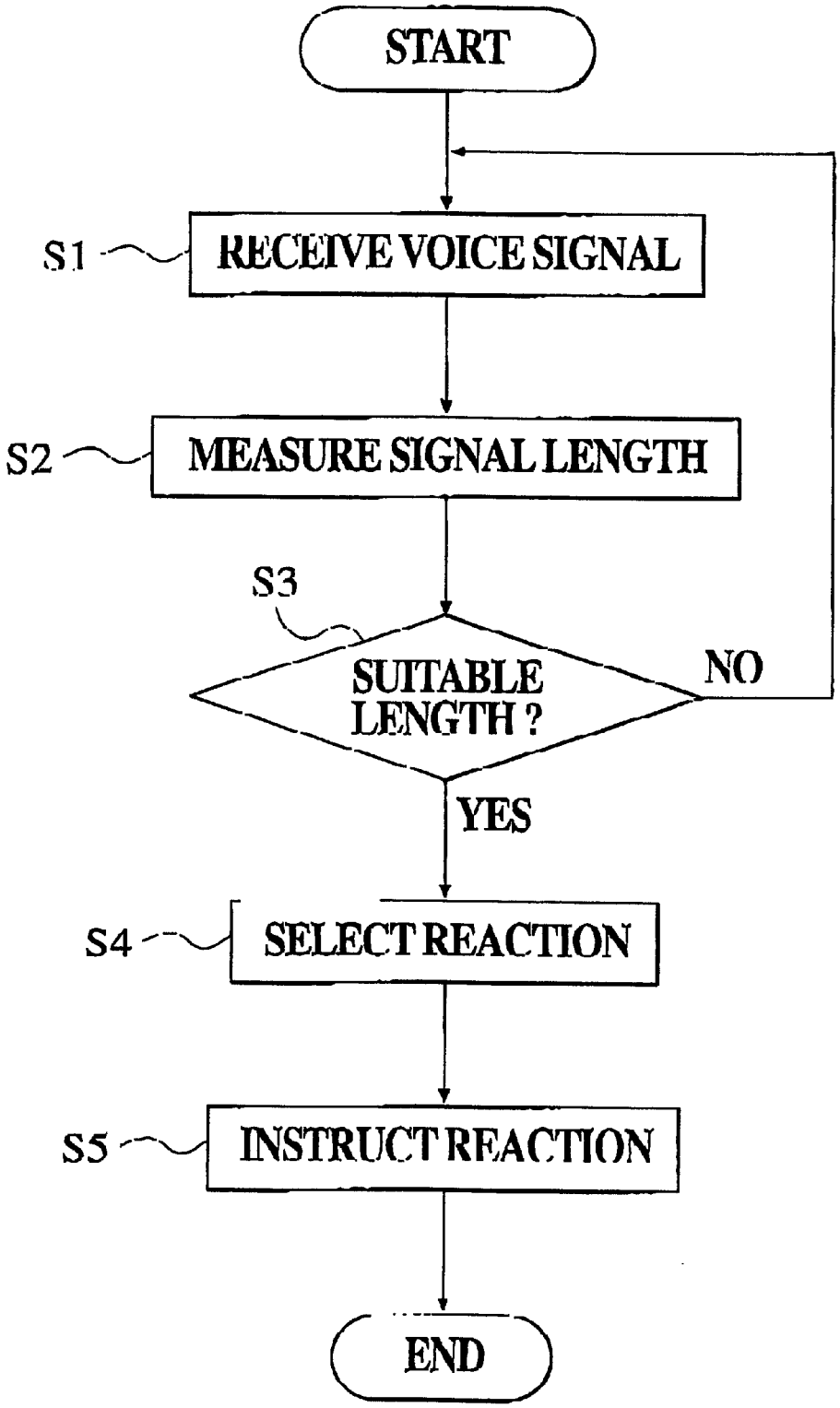
FIG. 8 is a block diagram showing the order of steps for the sound length recognition.

Next, an embodiment of the processing method by the processing unit 74 will be explained with reference to FIG. 8.

An analog voice signal corresponding to a speaker's voice, which is detected by the sound detection sensor 71 is amplified through the amplifier 72. Then, the amplified analog voice signal is converted into a digital voice signal through the integrating circuit 73 and is supplied to the processing unit 74, in step S1. The processing unit 74 has a speech recognition function, e.g., word recognition, sentence recognition or the like, and contains a measurement unit 75, a comparator 76, and a reaction selecting unit 77, as shown in FIG. 7. The digital voice signal is supplied to the measurement unit 75 in the processing unit 74 and thereby the time length of the digital voice signal is measured, in step S2. The measured time length of digital voice signal is compared with combinations of plural time lengths which are previously stored in a storage unit 78, and is judged whether the measured time length of voice elements is in a predetermined permitted range, by the comparator 76, in step S3. That is, when the measured time length of digital voice signal is in the predetermined permitted range, the reaction selecting unit 77 selects the reaction which corresponds to the recognized result by the processing unit 74, in step S4. The reactions to be selected by the reaction selecting unit 77 includes, for example, various patterns of turning on and off of the light emitters 51, of driving the electromagnets 23, and of generating sounds through the speaker 60. According to the selection result of reaction, the processing unit 74 sends an instruction for the corresponding part of the toy animal to perform the selected reaction, in step S5. Thereby, it is possible to operate wheels 17, eye members 50*a*, fore and rear leg members 18*a* and 18*b*, ear members 40, and the like, of the toy animal suitable and also to generate voices as if the toy animals has a conversation with the owner or the like.

Preferably, the light emitters 51 are turned on for a predetermined time when the processing unit 74 recognizes an input sound as a speaker's voice. Lighting of the light emitters 51 enables the speaker to understand that the toy animal has recognized the first speaker's voice. Thereby, the speaker can input a second voice timely before the light emitters 51 are turned off. When the processing unit 74 recognizes the second speaker's voice after operations for the second voice are performed like the case of inputting the first speaker's voice, the processing unit 74 sends an instruction for the corresponding part of the toy animal to perform the selected reaction, that is, driving the electromagnets 23, turning the light emitters 51 on and off, generating a predetermined voice through the speaker 60, or the like.

Figure 9:
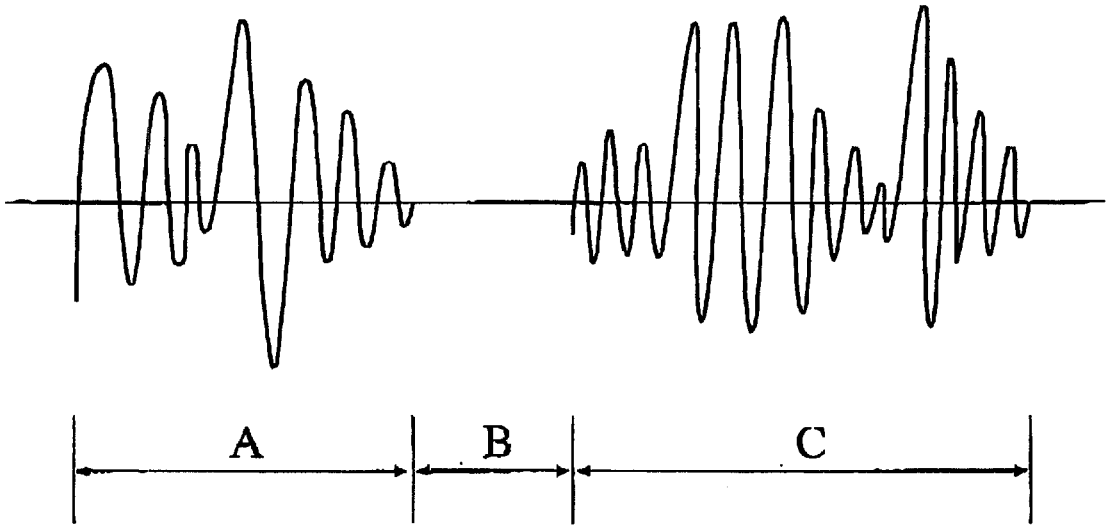
FIG. 9 is a view for explaining a principle of sound length recognition.

FIG. 9 is a view for explaining a principle of recognition of combination of time lengths for a speaker's voice. In this figure, the speaker's voice comprises a first voice element, e.g., "John", with a time length "A", a second voice element, e.g., "Rotate" will a time length "C", and a blank with a time length "B" between the first and second elements. For example, "John" and "Snoopy" are monosyllabic and disyllabic words, respectively, and "Rotate" and "Down" are disyllablic and monosyllabic words, respectively. It is understood that the voices "John, Rotate" and "Snoopy, Down" have combinations of approximate time lengths of "1-1-2" and "2-1-1", respectively. Here, the time length of each blank between the first and second words (elements) counts as 1.

In Japanese, for example, the speaker's voice comprises a first word, e.g., "Po-chi" which is a dog name in Japanese, with a time length "A, " a second word, e.g., "O-ma-wa-ri" in Japanese with a time length of "C", and a blank with a time length "B" between the first and second words. For example, each of "Po-chi" and "Chi-bi" is disyllabic word, and each of "O-ma-wa-ri" and "O-su-wa-ri" is four-syllabic word. The voice "Po-chi, O ma wa ri" has a combination of approximate time lengths of "2-1-4". Here, the time length of each blank between the first and second words counts as 1.

As described above, by giving the toy animal a speaker's voice which comprises a combination of approximate time lengths of successive plural elements, the toy animal may be recognized to have received a specific meaning corresponding the combination. When the combination of time lengths of a first word (element) with a time length "A", a blank with a time length "B" between the first and second words (elements), and the second word (element) with a time length "C" is in a predetermined permitted range of time length, recognition is performed. So far as the combination of the first element with "A" and the second element with "C" or the combination of the blank with "B" and the element with "C" is in a predetermined permitted range of time length, recognition can be also performed.

Figure 10:
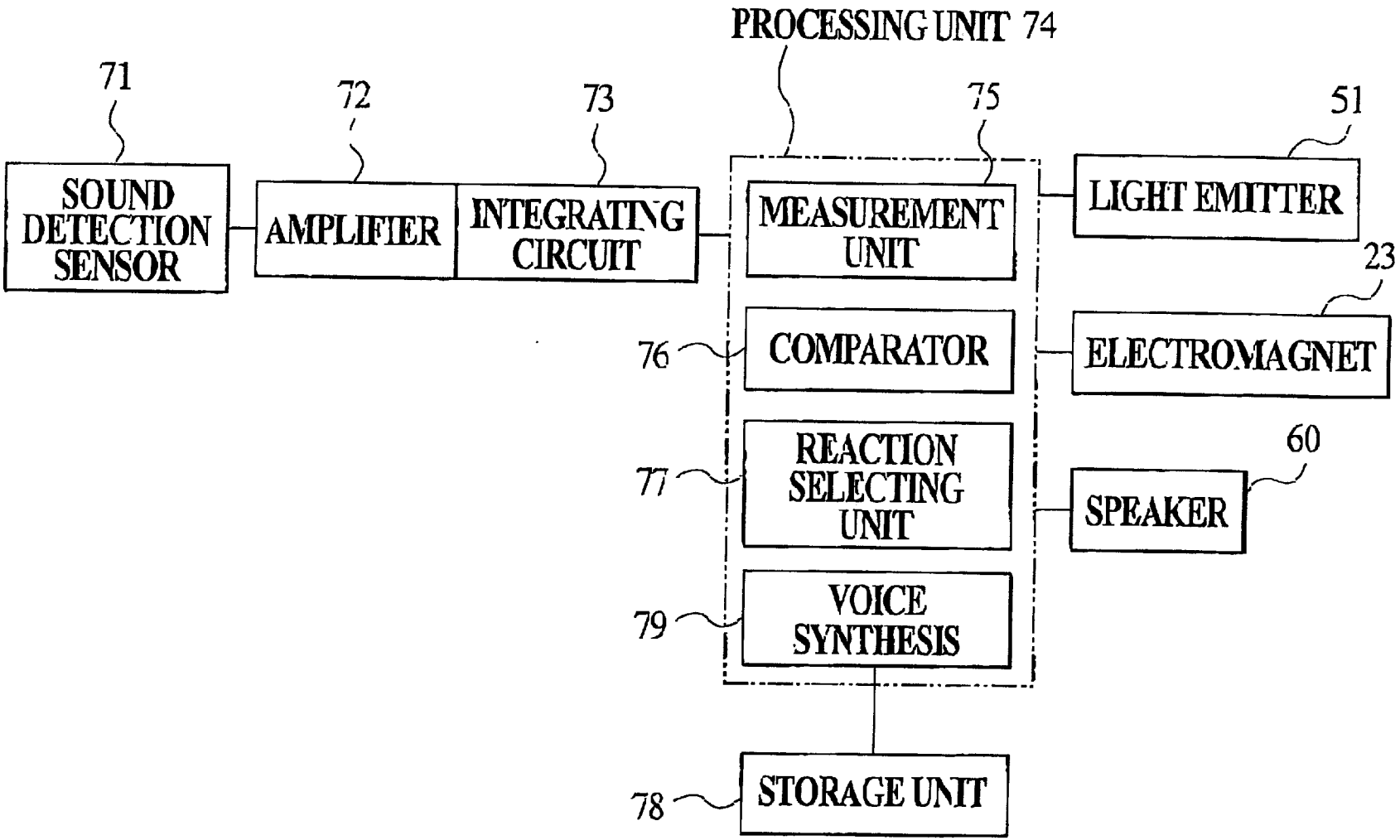
FIG. 10 is another block diagram of another embodiment of the circuit for recognizing a sound length.

FIG. 10 shows a second embodiment of the sound recognition circuit for recognizing sounds which has not only a voice (speech) recognition unit but also a voice synthesis unit (voice composer) 79.

In the second embodiment, when a switch of the power supply for the toy animal body is turned on, an animal voice sound composed by the voice synthesis 79 is amplified properly and output through the speaker 60. When the output of composed animal voice sound is finished, the light emitters 51 are turned on for a predetermined time. When a speaker inputs a voice corresponding to composed animal voice sound timely through the sound detection sensor (microphone) 71, the input voice is changed to an analog voice signal through the sound detection sensor 71 and amplified through the amplifier 72. In this case, the voice corresponding to the composed (synthesized) sound may be input immediately and also may be input with a pose (blank) after reception of the composed sound. Then, the amplified analog voice signal is converted into a digital voice signal through the integrating circuit 73 and is supplied to the processing unit 74. When an external voice signal with a time length approximately corresponding to that of the composed sound is supplied to the processing unit 74, the processing unit 74 outputs the result stored, corresponding to the content of the recognized voice on the basis of a program stored in the storage unit 78. As a result, the electromagnets 23 is driven, or the light emitters 51 is turned on and off, or the like, according to the content defined in a table of relationship between input voice signals and toy actions corresponding to the voice instruction signals, stored in the storage unit 78. According to such a voice instruction, it is possible to operate wheels 17, eye members 50*a*, fore and rear leg members 18*a* and 18*b*, ear members 40, and the like, of the toy animal suitable and also to generate a synthesized voice as if the toy animal has a conversation with the owner or the like.

Figure 11:
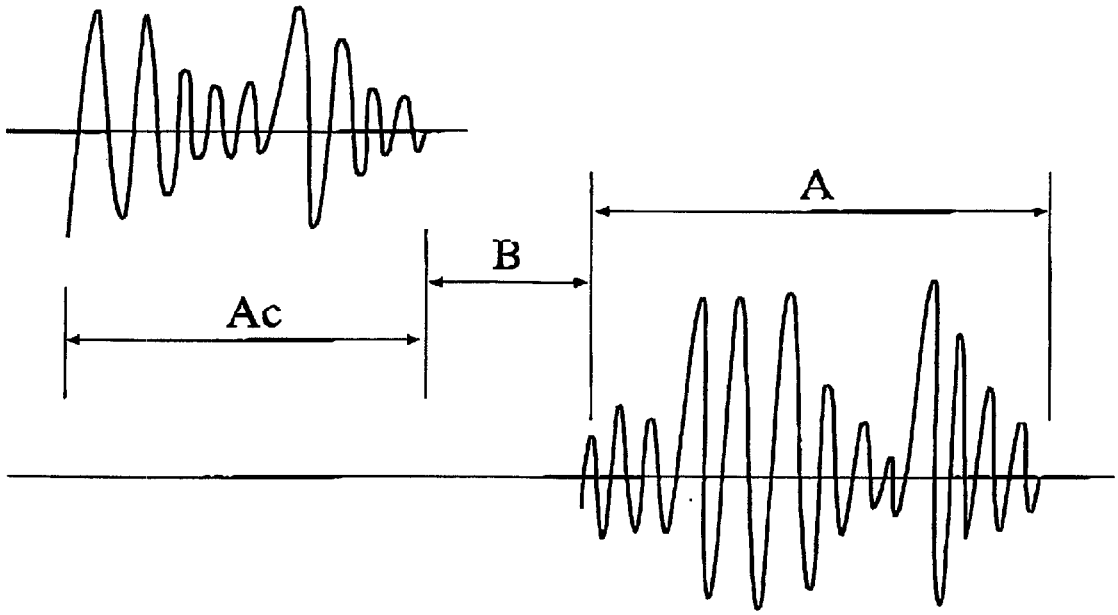
FIG. 11 is a view for explaining another principle of sound length recognition.

FIG. 11 is a view for explaining another principle of recognition of combination of time lengths for a speaker's voice. In this figure, "Ao" indicates a time length of a synthesize sound, e.g., "O-ha-yo" including 3 syllables in Japanese, which is generated by the voice synthesis unit 79. The lower waveform with a time length "A" shown in the figure indicates one of a speaker's voice "O-ha-yo" which corresponds to that of the synthesized sound. When the time length of "A" is approximately the same as that of "Ao", the processing unit 74 recognizes the sound with "A" as a speaker's voice. The reference character "B" is a time length of a blank (pose) between the end of the synthesized sound and the start of the speaker's voice. Existence of the blank "B" enables recognition of voice with little errors. Although in the former case, recognition of voice is performed by using only the speaker's voice time length "A", because in the latter case, it is performed by using the combination of the blank time length "B" and the speaker's voice time length "A", accuracy of recognition can be improved.

As a speaker's voice corresponding to the synthesized sound "Ao", to be stored in the storage unit 78, a voice which may be reminded by a person on the basis of the composed sound can be also adopted. For example, the words "Fuji-san" can be set and stored in the storage unit 78 as a speaker's voice "A" which corresponds to a synthesized sound "Ao" of "What is the highest mountain in Japan?" In this case, when the speaker responds a voice "Fuji-san" to the latter question of the composed sound "Ao", recognition of voice can be performed. According to this manner, it is possible to operate the toy animal simply without studying in detail a manual for operating the toy.

The present invention allows to perform various steps repeatedly each of which comprises generating a synthesized sound by the voice synthesis and responding an answer by a speaker's voice, using the operating unit 74, as if the toy animal has a conversation with the speaker, to understand each other in order. As a result, it enables making the operating unit 74 recognize many input matters and obey many orders.

In the toy animal, a shaft 12*b* is attached to the both sides of fore portion of upper body cover 12 and a pair of fore legs 18*a* and 18*a* are supported to be reciprocally rotatable around the shaft 12*b*, as shown in FIG. 2. Each fore leg 18*a* is attached to be able to swing onto the shaft 12*b* with a screw 19*f*. At a top free end portion in the inner surface of each fore leg 18*a*, a hole 18*d* is formed. In each hole 18*d*, a projecting boss 16*c* which is provided on the outer surface of the free end of each swing member 16, is fitted. As a result, when the swing member 16 swings back and forth, the corresponding fore leg 18*a* also swings back and forth. A pair of rear legs 18*b* and 18*b* are supported on both sides of rear portion of the upper body cover 12. A tail member 18*c* is attached to the upper surface of rear portion of the upper body cover 12.

Inside the upper head cover 14, a switch 80 made of rubber is provided. An operating portion 81 for operating the switch 80 is projected upward through a small hole 14*b* which is formed in the upper head cover 14. The power supply for the toy animal is turned on by pressing down the operating portion 81.

The lower body cover 11 is attached to the base member 10 with a screw 19*a* and a nut 19*b*. The base member 10, the upper body cover 12 and the lower head cover 13 are attached to one another with a screw 19*c*. The lower head cover 13 and the upper head cover 14 are attached to each other with a screw 19*d*. The wheels 17 and 17, the ratchet pawl members 32 and 32, and the swing members 16 and 16 are attached to the base member 10 with a pin 19*e*. The attachment member 70 is attached to the upper head cover 14 with a screw 19*g*.

In the above described embodiment, running of the toy animal, swinging of ear members 40, turning on of light emitters 51, generation of composed voice, and the like are performed on the basis of the sound input into the sound detection sensor 71. However, those operations may be also performed by providing a receiver in the toy animal and by using radio signals from the outside.

In the above-described embodiment, although only a toy animal with wheels is explained, the present invention may be applied to another type of toy, e.g., a vehicle toy or the like.

Although only a button type of battery is used as a power supply, another type of battery, e.g., a small-sized nickel cadmium rechargeable battery or the like, may be also used.

Although operations (including generation of sound) in the action toy are performed by responding to input sound, it is also possible for the action toy to have a conversation or to sing in a chorus, with another action toy by recognizing or distinguishing the approach to or existence of another action toy by using infrared radiation, an optical sensor, a data carrier and the like. Further, the action toy of the invention may have a structure to enable operation in response to light by using an optical sensor, or in response to a human stimulation, e.g., stroking, hitting or the like. That is, the action toy may also may a structure to enable operation in response to an external stimulation other than sound.

The entire disclosure of Japanese Patent Application Nos. Tokugan 2002-078673 which was filed on Mar. 20, 2002, including specification, claims, drawings and summary are incorporated herein by reference in its entirety.

What is claimed is:

1. A driving apparatus for an action toy comprising:

a base member;

a swing member which is reciprocally swingable on a predetermined axis formed in the base member;

an electromagnet which is attached to one of the base member and the swing member;

a control circuit for controlling electric current supplied to the electromagnet;

at least a magnetic material member which is attached to the other of the base member and the swing member to allow the swing member to swing reciprocally with respect to the base member by a magnetic force which acts between the electromagnet and the magnetic material member; and a ratchet mechanism for converting a swinging movement of the swing member to a rotational movement of a wheel, the ratchet mechanism comprising a ratchet pawl member and ratchet teeth engageable with the ratchet pawl member.

2. The driving apparatus as claimed in claim 1, wherein the ratchet teeth are provided in the wheel.

3. The driving apparatus as claimed in claim 1, wherein the swing member supports the ratchet pawl member to allow it to move in a vertical direction and to descend by its own weight.

4. The driving apparatus as claimed in claim 3, wherein a projecting pawl is formed at a portion of the ratchet pawl member in a descending direction of the ratchet pawl member by its own weight.

5. The driving apparatus as claimed in claim 4, wherein the swing member supports the ratchet pawl member by a projecting cylindrical bearing which is disposed on a side surface of the swing member and centered at the axis of swinging for the swing member.

6. The driving apparatus as claimed in claim 5, wherein the projecting cylindrical bearing comprises a projection with a small width, which is formed on a periphery thereof and extending in a vertical direction, and a through hole is formed in the ratchet pawl member so that the projecting cylindrical bearing is fitted with a play and the ratchet pawl member is movable with respect to the projecting cylindrical bearing in a vertical direction.

7. The driving apparatus as claimed in claim 6, wherein the through hole formed in the ratchet pawl member has a first approximately rectangular hole with a width slightly larger than an outer diameter of the cylindrical bearing and a second hole with a width slightly larger than the small width of the projection of the cylindrical bearing.

8. The driving apparatus as claimed in claim 3, wherein the ratchet teeth are provided in the wheel.

9. The driving apparatus as claimed in claim 1, wherein the swing member swings a leg of the action toy.

10. The driving apparatus as claimed in claim 1, wherein the ratchet teeth are internal teeth.

11. The driving apparatus as claimed in claim 1, wherein current flowing in the electromagnet is controlled in response to an external stimulation.

12. The driving apparatus as claimed in claim 11, wherein the external stimulation is a sound.

13. The driving apparatus as claimed in claim 12, wherein the driving apparatus performs a reaction in response to a length of the sound.

14. The driving apparatus as claimed in claim 13, further comprising:

a storage unit for storing sound information including a plurality of combinations each having a sound element or plural sound elements and a pose between the sound elements, or a sound, and a predetermined range of time length; and a processing unit for recognizing an external voice when a measured time length of the external voice is in the predetermined range of time length stored in the storage unit, and controlling to make a driver to perform a reaction for an action toy, corresponding to a recognized result.

15. The driving apparatus as claimed in claim 14, wherein the processing unit further comprises a voice synthesis for synthesizing a sound like a voice.

16. The driving apparatus as claimed in claim 15, wherein the apparatus comprises:

the storage unit for storing various voices synthesized by the voice synthesis;

a voice output unit for outputting a voice synthesized by the voice synthesis; and a processing unit for recognizing an external voice when a measured time length of the external voice is in the predetermined range of time length with respect to the voice synthesized, and controlling to make a driving device to perform a reaction for an action toy, corresponding to a recognized result.

17. The driving apparatus as claimed in claim 15, wherein the apparatus comprises:

the storage unit for storing a plurality of combinations each having time lengths of sound elements and a pose between the sound elements, of a sound synthesized; and a processing unit for recognizing an external voice when a measured combination of time lengths of sound elements and a pose, of the external voice is in the predetermined range of time length with respect to the voice synthesized, and controlling to make a device to perform the corresponding reaction for the action toy.

18. The driving apparatus for an action toy as claimed in claim 1, further comprising a button type of battery as a power source.

19. An action toy having a driving apparatus, the driving apparatus comprising:

a base member;

a swing member which is reciprocally swingable on a predetermined axis formed in the base member;

an electromagnet which is attached to one of the base member and the swing member;

a control circuit for controlling electric current supplied to the electromagnet;

at least a magnetic material member which is attached to the other of the base member and the swing member to allow the swing member to swing reciprocally with respect to the base member by a magnetic force which acts between the electromagnet and the magnetic material member; and a ratchet mechanism for converting a swinging movement of the swing member to a rotational movement of a wheel, the ratchet mechanism comprising a ratchet pawl member and ratchet teeth engageable with the ratchet pawl member.

* * * * *